US008313397B2

(12) United States Patent
Watari et al.

(10) Patent No.: US 8,313,397 B2
(45) Date of Patent: Nov. 20, 2012

(54) BATTING TOOL AND BALL-GAME BAT

(75) Inventors: Makoto Watari, Yokohama (JP); Katsumi Shimohira, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 231 days.

(21) Appl. No.: 12/755,497

(22) Filed: Apr. 7, 2010

(65) Prior Publication Data

US 2011/0172038 A1 Jul. 14, 2011

(30) Foreign Application Priority Data

Jan. 8, 2010 (JP) ..... P2010-003380

(51) Int. Cl.
*A63B 59/06* (2006.01)

(52) U.S. Cl. ..... 473/564; 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 6,485,382 | B1 * | 11/2002 | Chen | 473/566 |
| 6,878,080 | B2 * | 4/2005 | Chang | 473/564 |
| 7,311,620 | B1 | 12/2007 | Heald et al. | |
| 7,419,446 | B2 * | 9/2008 | Nguyen | 473/567 |
| 7,798,926 | B1 * | 9/2010 | Hsu | 473/566 |
| 2003/0158006 | A1 * | 8/2003 | Tribble | 473/564 |
| 2004/0224803 | A1 | 11/2004 | Forsythe et al. | |
| 2006/0252586 | A1 | 11/2006 | Nguyen | |
| 2006/0293130 | A1 * | 12/2006 | Guenther et al. | 473/564 |
| 2007/0191156 | A1 * | 8/2007 | Van Nguyen | 473/564 |
| 2007/0207882 | A1 | 9/2007 | Van Nguyen | |
| 2009/0264230 | A1 * | 10/2009 | Thouin | 473/567 |

FOREIGN PATENT DOCUMENTS

| | | |
|---|---|---|
| JP | 2003-299756 | 10/2003 |
| JP | 3529966 | 3/2004 |
| JP | 2005-312911 | 11/2005 |
| JP | 2009-521989 | 6/2009 |

* cited by examiner

*Primary Examiner* — Mark Graham
(74) *Attorney, Agent, or Firm* — Jordan and Hamburg LLP

(57) ABSTRACT

A bat includes a handle having a handle joint, a barrel having a barrel joint and a barrel joint opening at an end of the barrel joint, and a connector connecting the handle joint and barrel joint together. The barrel joint has a first support hole formed proximal to the barrel joint opening, a second support hole formed distal to the barrel joint opening and having a larger diameter than the first support hole, and a receiver formed between the first and second support holes orthogonal to an axis of the holes. The connector has a handle connection connected to the handle joint, a first barrel connection formed on an outer periphery of the connector and engaging with the first support hole, a second barrel connection formed on an outer periphery of the connector and engaging with the second support hole.

9 Claims, 6 Drawing Sheets

BATTING TOOL AND BALL-GAME BAT

BACKGROUND OF THE INVENTION

1. Field of the Invention

The present invention relates to a batting tool and a ball-game bat.

2. Description of Related Art

A ball-game bat such as a baseball bat generally includes a handle grasped by a player and a barrel to hit a ball.

Examples of ball-game bats are disclosed in, for example, Japanese Unexamined Patent Application Publication No. 2005-312911 and Japanese Patent Publication No. 3529966. These bats have a handle and a barrel that are separately made and are joined together. By selecting materials, the bats have durability for repetition of hitting or light weight for high batting speed.

The related arts form the bat by fitting a tapered outer diameter part of the handle into a tapered inner diameter part of the barrel and by fastening the handle and barrel to each other or bonding them together.

The related arts have a weakness in joint strength between the handle and the barrel. When bending force is applied to the bat, a stress concentration occurs along the joint between the handle and the barrel, to loosen the coupling of the tapered outer and inner diameter parts, bend the bat at the joint, or cause a rattle. If the bat receives a longitudinal compressive shock, the tapered outer and inner diameter parts will come out of joint so that the handle comes into the barrel.

SUMMARY OF THE INVENTION

An object of the present invention is to provide a bat having a sufficient joint strength between a handle and a barrel.

In order to accomplish the object, an aspect of the present invention provides a batting tool including a handle having a handle joint, a barrel having a barrel joint and a barrel joint opening at an end of the barrel joint, and a connector connecting the handle joint and barrel joint together. The barrel joint has a first support hole formed proximal to the barrel joint opening, a second support hole formed distal to the barrel joint opening and having a larger diameter than the first support hole, and a receiver formed between the first and second support holes. The connector has a handle connection connected to the handle joint, a first barrel connection formed on an outer periphery of the connector and engaging with the first support hole, a second barrel connection formed on the outer periphery of the connector and engaging with the second support hole, a stopper formed between the first and second barrel connections, and an outer fastener engaging with a periphery of the barrel joint opening and being tightened to press the stopper and receiver to each other.

According to this aspect of the present invention, bending force applied to the joint between the handle and the barrel is tenaciously received by the jointing between the first and second support holes of the barrel and the first and second barrel connections of the connector fixed to the handle, the firm contact between the receiver of the barrel and the stopper of the connector, and the engagement between the periphery of the barrel joint opening of the barrel and the outer fastener of the connector. The batting tool according to this aspect has an improved joint strength against bending force applied to the joint between the handle and the barrel.

A longitudinal compressive shock applied to the batting tool is received by the attachment between the periphery of the barrel joint opening of the barrel and the outer fastener of the connector. Namely, the batting tool according to this aspect has an improved joint strength against a compressive shock applied to the bat.

DETAILED DESCRIPTION OF EMBODIMENTS

Ball-game bats having connectors to improve joint strength between a handle and a barrel according to embodiments of the present invention will be explained in detail with reference to the drawings.

Figure 1:
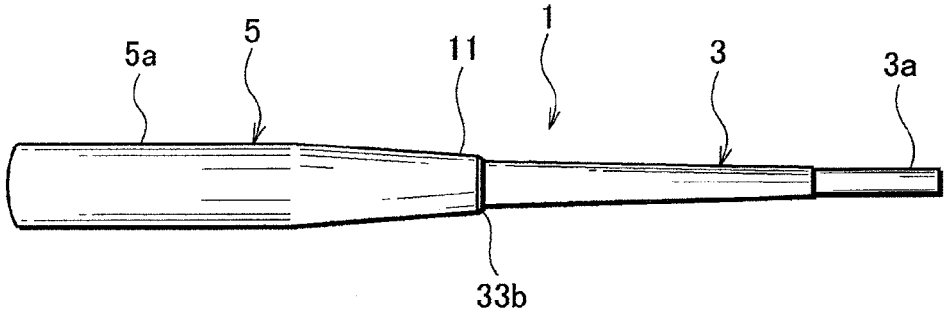
FIG. 1 is a general view illustrating a ball-game bat according to a first embodiment of the present invention with a cap and a knob omitted.
Figure 2:
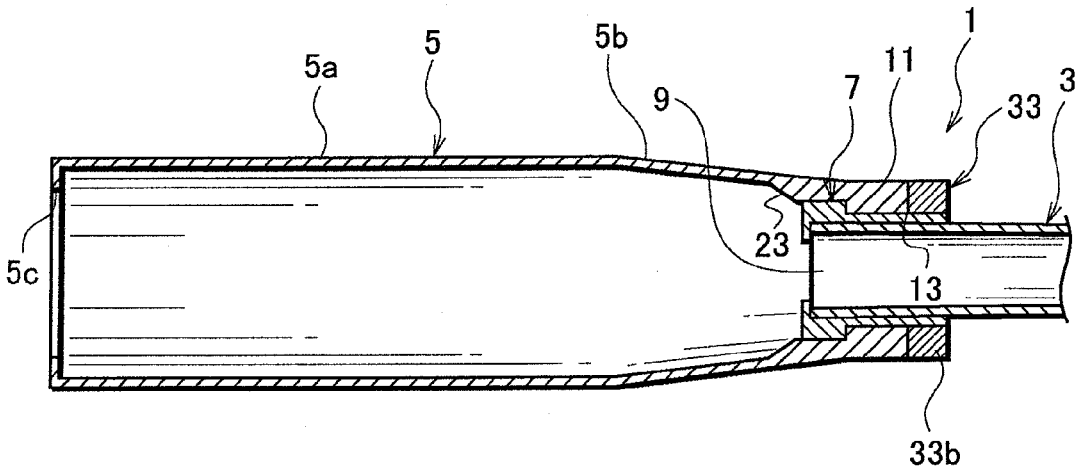
FIG. 2 is a sectional view partly illustrating the bat of FIG. 1.
Figure 3:
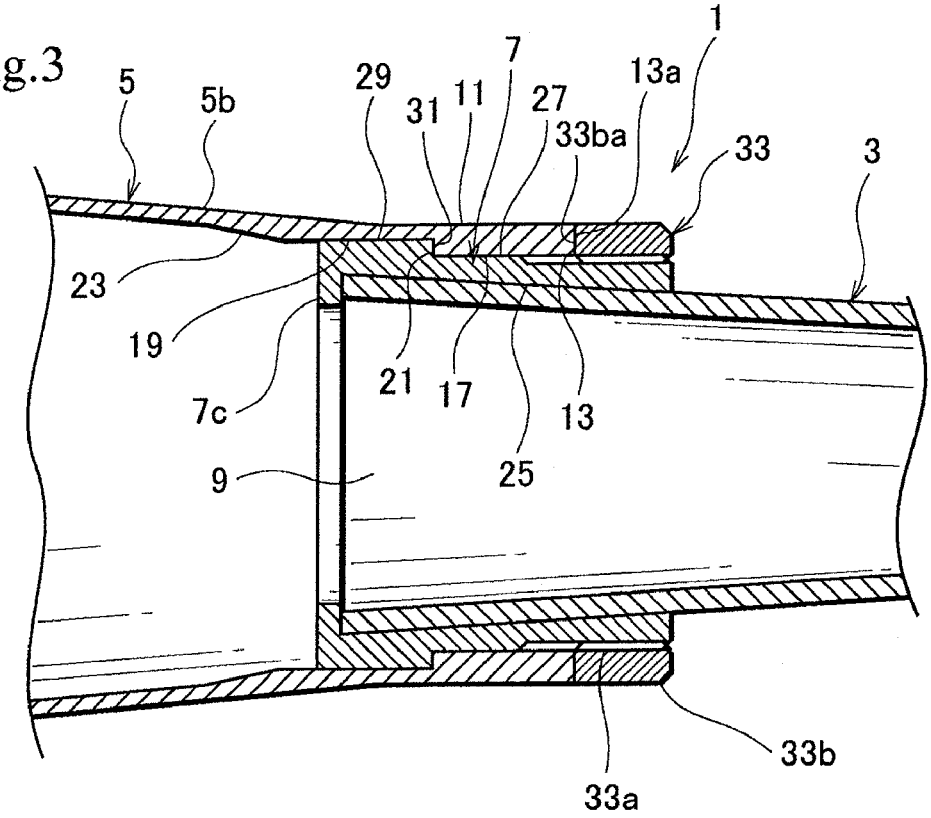
FIG. 3 is an enlarged sectional view illustrating an essential part of the bat of FIG. 1.

A ball-game bat according to a first embodiment of the present invention will be explained with reference to FIGS. 1 to 3 in which FIG. 1 is a general view of the bat with a cap and a knob omitted, FIG. 2 is a sectional view of the bat, and FIG. 3 is an enlarged sectional view of an essential part of the bat.

The bat 1 as a batting tool according to the first embodiment has a handle 3 and a barrel 5. The handle 3 and barrel 5 are joined together through a connector 7. The handle 3 and barrel 5 each are a hollow pipe and are optionally made of different materials or the same material. For example, the handle 3 and barrel 5 are made of a material selected from the group consisting of aluminum alloy, stainless steel, duralumin, FRP, scandium alloy, and titanium alloy. Instead, the handle 3 may be made of FRP and the barrel 5 may be made of aluminum alloy.

The handle 3 has a handle joint 9. The barrel 5 has a barrel joint 11 at which a barrel joint opening 13 is formed. The connector 7 is connected and fitted to the handle joint 9, and through the connector 7, the handle joint 9 is fixed to the barrel joint 11.

The handle 3 has an end part 3*a* having predetermined inner and outer diameters. The handle 3 gradually widens from an end of the end part 3*a* toward the handle joint 9. Accordingly, the handle joint 9 has a widening shape.

The barrel 5 has a body part 5*a* on a front end side of the barrel 5. The body part 5*a* is a pipe having predetermined inner and outer diameters. A tapered part 5*b* is formed adjoining the body part 5*a* that leads to the barrel joint 11 in the handle 3 side. A front end of the body part 5*a* has a hole 5*c* for fitting a cap.

The barrel joint 11 has a first support hole 17, a second support hole 19, and a receiver 21 on an inner periphery thereof.

The first support hole 17 is proximal to the barrel joint opening 13 and has a predetermined inner diameter from the barrel joint opening 13. The first support hole 17 is concentric with the barrel 5. The second support hole 19 is on a deeper side with respect to the first support hole 17 and is distal to the barrel joint opening 13. The second support hole 19 has a larger diameter than the first support hole 17 and is concentric with the barrel 5. Between the second support hole 19 and the tapered part 5*b*, a tapered guide hole 23 is formed.

The receiver 21 is formed between the first and second support holes 17 and 19 and is a face orthogonal to an axis of the first and second support holes 17 and 19, i.e., an axis of the barrel 5.

The barrel joint opening 13 has a terminal end face 13*a* that is orthogonal to the axis of the first and second support holes 17 and 19, i.e., the axis of the barrel 5.

The connector 7 has a cylindrical shape and has a handle connection 25, a first barrel connection 27, a second barrel connection 29, a stopper 31, and an outer fastener 33.

The handle connection 25 is formed on an inner periphery of the connector 7 and is a tapered hole having an inner diameter to fit the handle joint 9 of the handle 3. An axial inner end of the connector 7 has a bent 7*c* that is formed by spinning. The bent 7*c* functions as an inner fastener that axially engages with and pushes a front end of the handle 3 so as to fit and fasten the handle connection 25 to the handle joint 9. This aligns the axis of the handle 3 with the axis of the connector 7 through the tapers.

The first barrel connection 27 is formed on an outer periphery of the connector 7 and has an outer diameter to radially engage with an inner periphery of the first support hole 17 and be tightly fitted into the first support hole 17 of the barrel 5. The first barrel connection 27 is concentric with the handle connection 25.

The second barrel connection 29 is formed on the outer periphery of the connector 7 and has an outer diameter to radially engage with an inner periphery of the second support hole 19 and be tightly fitted into the second support hole 19 of the barrel 5. The second barrel connection 29 is concentric with the handle connection 25.

The stopper 31 is formed between the first and second barrel connections 27 and 29 and is a face orthogonal to the axis of the connector 7. The stopper 31 is pressed to the receiver 21 of the barrel 5.

The outer fastener 33 includes an outer external thread 33*a* and a lock nut 33*b*. The thread 33*a* is formed along an outer end extension and circumference thereof of the connector 7 that axially outwardly protrudes from the barrel joint opening 13 and is continuous to the first barrel connection 27.

The lock nut 33*b* has a fastening end face 33ba orthogonal to an axis of the lock nut 33*b*. The lock nut 33*b* has an outer circumferential face whose diameter is equal to an outer diameter of the barrel joint 11 of the barrel 5 and whose section is circular. The lock nut 33*b* axially engages with the end face 13*a* that is a periphery of the barrel joint opening 13. The lock nut 33*b* is fastened to the thread 33*a* so that the end face 33ba is axially pressed to the end face 13*a* and so that the stopper 31 is axially pressed to the receiver 21. The outer fastener 33 may be replaced with caulking.

Joining the handle 3 and barrel 5 together will be explained.

The connector 7 with the lock nut 33*b* removed is fitted to the handle joint 9 of the handle 3 and the bent 7*c* is formed by spinning. The bent 7*c* serves as an inner fastener that axially pushes the front end of the handle 3, thereby joining the handle connection 25 and handle joint 9 together.

The end part 3*a* of the handle 3 is inserted into the hole 5*c* at the front end of the barrel 5 and the connector 7 is fitted into the barrel joint 11, so that the first and second barrel connections 27 and 29 are fitted into the first and second support holes 17 and 19 and the stopper 31 is pressed to the receiver 21.

When inserting the second barrel connection 29 into the second support hole 19, the tapered guide hole 23 makes the insertion easy.

The lock nut 33*b* is fastened to the thread 33*a* of the connector 7 that protrudes from the barrel joint opening 13 of the barrel 5. The lock nut 33*b* is tightened up to the end face 13*a* of the barrel joint opening 13, so that the stopper 31 is pressed to the receiver 21.

Thereafter, a cap (not illustrated) is attached to the hole 5*c* at the top of the barrel 5.

In this way, the bat 1 according to the first embodiment of the present invention includes the handle 3 having the handle joint 9, the barrel 5 having the barrel joint 11 and the barrel joint opening 13 at an end of the barrel joint 11, and the connector 7 connecting the handle joint 9 and barrel joint 11 together. The barrel joint 11 has the first support hole 17 formed proximal to the barrel joint opening 13, the second support hole 19 formed distal to the barrel joint opening 13 and having a larger diameter than the first support hole 17, and the receiver 21 formed between the first and second support holes 17 and 19 orthogonal to the axis of the holes 17 and 19. The connector 7 has the handle connection 25 connected to the handle joint 9, the first barrel connection 27 connected to the first support hole 17, the second barrel connection 29 connected to the second support hole 19, the stopper 31 formed between the first and second barrel connections 27 and 29 orthogonal to the axis of the connections 27 and 29, and the outer fastener 33 having the thread 33*a* and lock nut 33*b* and attached to the periphery of the barrel joint opening 13, the thread 33*a* and lock nut 33*b* of the outer fastener 33 being fastened to each other to press the stopper 31 and receiver 21 to each other.

According to the first embodiment, bending force applied between the handle 3 and the barrel 5 is received by the coupling of the first and second support holes 17 and 19 and first and second barrel connections 27 and 29 and by the load bearing between the receiver 21 and the stopper 31. The load bearing between the receiver 21 and the stopper 31 is achieved when the receiver 21 and stopper 31 lean to each other and circumferentially press each other due to the bending force.

If a longitudinal compressive shock is applied to the bat 1, the end face 33ba of the lock nut 33*b* is pressed to the end face 13*a* of the barrel joint opening 13, to receive the shock.

In this way, the bat 1 according to the first embodiment improves strength at the joint between the handle 3 and the barrel 5 against the bending force and longitudinal compressive shock applied to the bat 1.

The receiver 21, stopper 31, end face 33ba, and end face 13*a* are orthogonal to the axes of the handle 3 and barrel 5, and therefore, the axes of the handle 3 and barrel 5 never cross each other. This makes it easy to carry out the centering of the handle 3 and barrel 5.

The barrel 5 has the cap (not illustrated), and therefore, any one of the barrel 5 and handle 3 is replaceable with another. This is advantageous when the barrel 5 or the handle 3 is damaged, or when testing a different batting feeling with different material, or when changing the weight of the bat 1.

The handle joint 9 of the handle 3 has a tapered shape engaging with the tapered hole of the handle connection 25 of the connector 7. The connector 7 has the bent 7*c* to press the front end of the handle 3 so that the handle connection 25 may tightly engage with the handle joint 9.

Bending force applied between the handle 3 and the connector 7 and a longitudinal compressive shock are received by the tapered handle joint 9 and handle connection 25 and by the front end of the handle 3 and bent 7*c*. The bat 1 according to the first embodiment, therefore, has improved strength at the joint between the handle 3 and the connector 7 against the bending force and longitudinal compressive shock applied to the bat 1.

The outer fastener 33 has the thread 33*a* formed on the connector 7 and the lock nut 33*b* fastened to the thread 33*a*. When the lock nut 33*b* is fastened to the thread 33*a* at the barrel joint opening 13, the stopper 31 is pressed to the receiver 21. Namely, the end face 33ba of the lock nut 33*b* is tightly pressed to the end face 13*a* of the barrel joint opening 13, to easily press the stopper 31 to the receiver 21.

Figure 4:
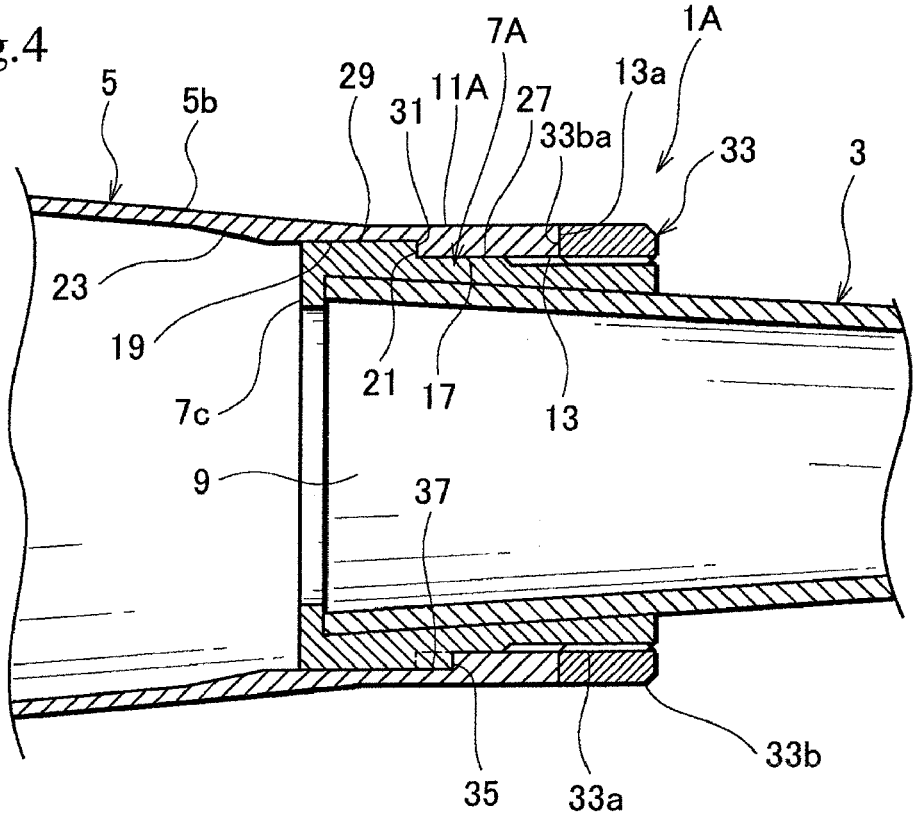
FIG. 4 is an enlarged sectional view illustrating an essential part of a ball-game bat according to a second embodiment of the present invention.
Figure 5A:
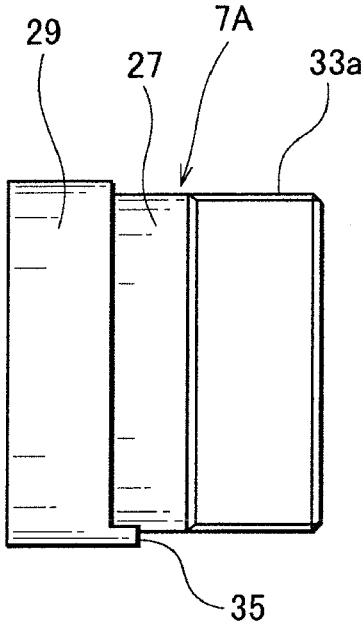
FIG. 5A is a side view illustrating a connector of the bat of FIG. 4.
Figure 5B:
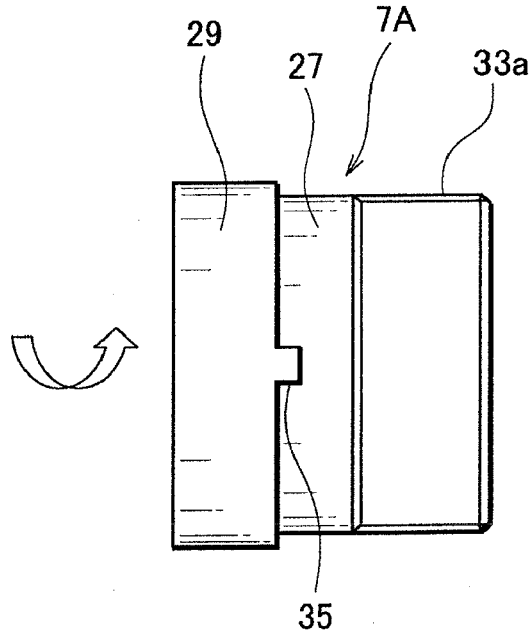
FIG. 5B is a 90-degree-turned view of FIG. 5A.

A ball-game bat according to a second embodiment of the present invention will be explained with reference to FIGS. 4, 5A, and 5B in which FIG. 4 is an enlarged sectional view illustrating an essential part of the bat, FIG. 5A is a side view illustrating a connector of the bat, and FIG. 5B is a 90-degree-turned view of FIG. 5A. The second embodiment is basically the same as the first embodiment, and therefore, the same or corresponding parts are represented with the same reference marks or the same reference marks plus "A" to omit a repetition of explanations.

The bat 1A according to the second embodiment includes a connector 7A having a projection 35. To engage with the projection 35, a recess 37 is formed on a first support hole 17 of a barrel joint 11A of a barrel 5. The engaging projection 35 and recess 37 prevent the connector 7A and barrel 5 from turning relative to each other. It is possible to form the recess 37 on the connector 7A and the projection 35 on the barrel joint 11A.

In this way, the second embodiment provides one of the barrel joint 11 A of the barrel 5 and the connector 7A with the projection 35 and the other thereof with the recess 37, to prevent the barrel 5 and connector 7A from turning relative to each other. The number of the pair of the projection 35 and recess 37 may be two or more instead of one.

The second embodiment prevents a relative turn of the barrel 5 and connector 7A, thereby improving joint strength between them, or between the barrel 5 and a handle 3. In addition, the second embodiment provides the effect of the first embodiment.

Figure 6:
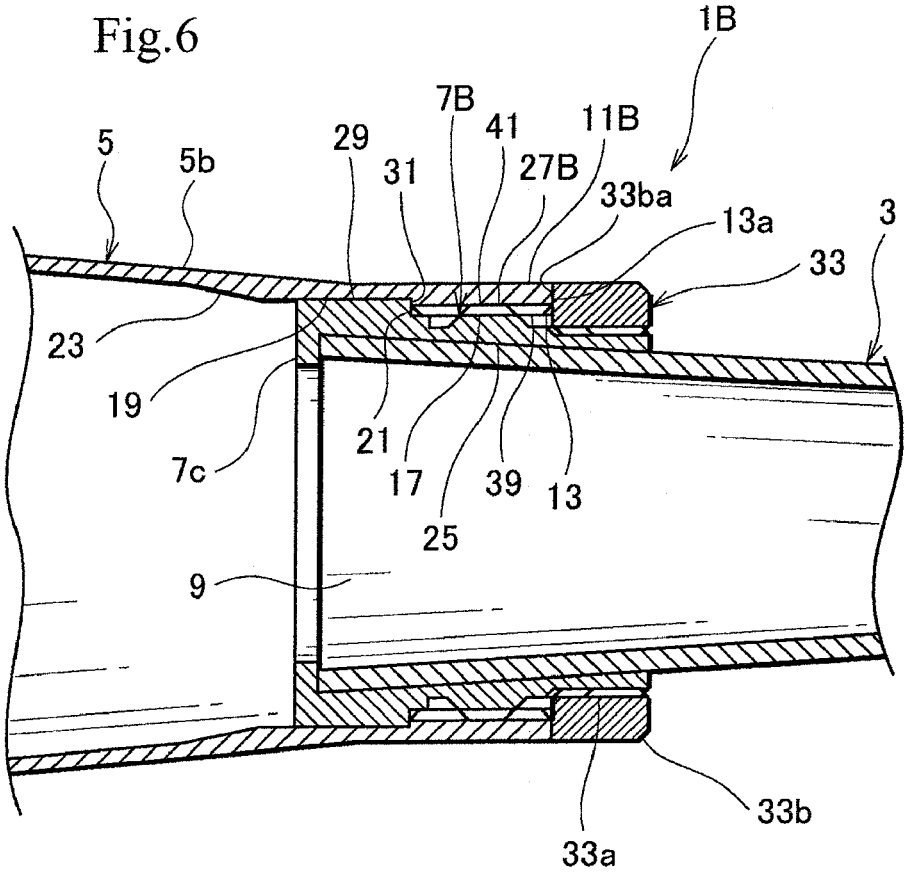
FIG. 6 is an enlarged sectional view illustrating an essential part of a ball-game bat according to a third embodiment of the present invention.

A ball-game bat according to a third embodiment of the present invention will be explained with reference to FIG. 6 that is a sectional view illustrating an essential part of the bat. The third embodiment is basically the same as the first embodiment, and therefore, the same or corresponding parts are represented with the same reference marks or the same reference marks plus "B" to omit a repetition of explanations.

According to the bat 1B of the third embodiment, a first support hole 17 of a barrel joint 11B of a barrel 5 has an internal thread 39 that engages with an inner external thread 41 formed on a first barrel connection 27B of a connector 7B. The thread 41 has a larger diameter than an outer external thread 33*a*.

The thread 41 is engaged with the thread 39 to press a stopper 31 to a receiver 21 and a lock nut 33*b* is engaged with the thread 33*a*, to provide an effect of double nuts.

When assembling the bat 1B, a handle 3 is inserted into a hole 5*c* (FIG. 2) of the barrel 5. At this time the thread 33*a* does not interfere with the thread 39 of the first support hole 17, and therefore, the assembling work is easy.

The threads 41 and 33*a* may have the same diameter, to simplify manufacturing.

The third embodiment also provides the effect of the first embodiment.

Figure 7:
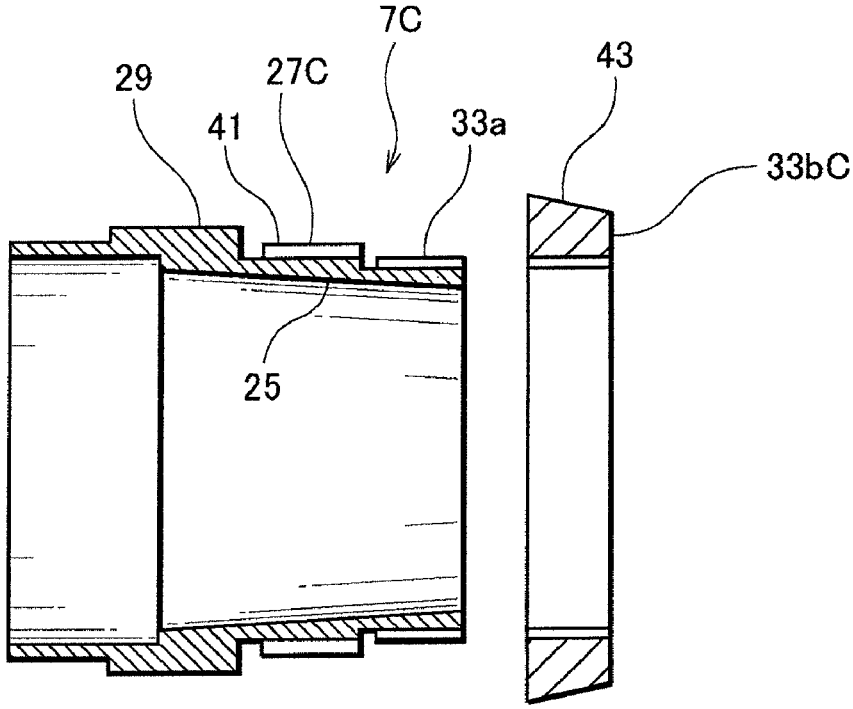
FIG. 7 is an exploded sectional view illustrating a connector of a ball-game bat according to a fourth embodiment of the present invention.

A ball-game bat according to a fourth embodiment of the present invention will be explained with reference to FIG. 7 that is a sectional view illustrating a connector of the bat. The fourth embodiment is basically the same as the third embodiment of FIG. 6, and therefore, the same or corresponding parts are represented with the same reference marks, or the same reference marks plus "C", or "C" instead of "B" to omit a repetition of explanations.

According to the fourth embodiment, the connector 7C has a lock nut 33*b*C provided with a tapered outer circumferential face 43. The largest diameter of the tapered outer circumferential face 43 is equal to the outer diameter of a barrel joint 11B (FIG. 6) of a barrel 5. The connector 7C of FIG. 7 is before forming a bent 7*c* (FIG. 6) serving as an inner fastener.

The tapered lock nut 33*b*C suppresses a circumferential step between the barrel joint 11B and a handle 3 (FIG. 6), so that the external shape of the barrel 5 smoothly continues to the external shape of the handle 3.

The lock nut 33*b*C of the fourth embodiment is applicable to the first and second embodiments.

A ball-game bat according to the fifth embodiment of the present invention will be explained with reference to FIG. 8 that is a sectional view illustrating a connector of the bat. The fifth embodiment is basically the same as the first embodiment of FIG. 3, and therefore, the same or corresponding parts are represented with the same reference marks or the same reference marks plus "D" to omit a repetition of explanations.

According to the fifth embodiment, the connector 7D has a lock nut 33*b*D that is integrally provided with a tapered cylinder 45. The tapered cylinder 45 has a tapered outer circumferential face 45*a* and a tapered inner circumferential face 45*b*. The largest diameter of the tapered outer circumferential face 45*a* is equal to the outer diameter of a barrel joint 11 (FIG. 3) and the smallest diameter thereof is substantially equal to the outer diameter of a handle 3 (FIG. 3) at a position where the tapered cylinder 45 engages with the handle 3.

The largest diameter r1 of the tapered inner circumferential face 45*b* is equal to the smallest diameter r2 of a handle connection 25 of the connector 7D. The taper of the tapered inner circumferential face 45*b* is similar to the taper of the handle connection 25 of the connector 7D although they have different diameters.

Figure 8:
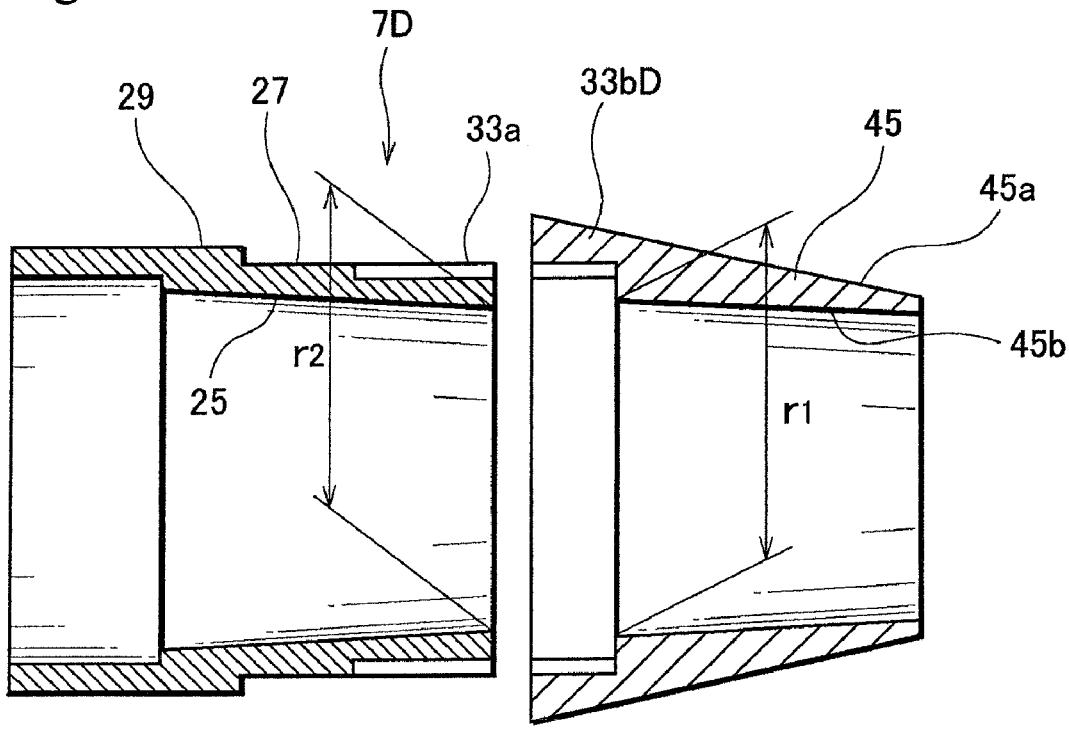
FIG. 8 is an exploded sectional view illustrating a connector of a ball-game bat according to a fifth embodiment of the present invention.

The connector 7D of FIG. 8 is before forming a bent 7*c* (FIG. 3).

The tapered inner circumferential face 45*b* of the lock nut 33*b*D is continuous to the handle connection 25 of the connector 7D, to receive the handle 3 and fit thereto. The tapered outer circumferential face 45*a* suppresses a circumferential step between the barrel joint 11 and the handle 3, to smoothly continue the external shapes of the barrel 5 and handle 3.

The tapered cylinder 45 receives bending force applied between the handle 3 and the barrel 5, thereby improving joint strength between the handle 3 and the barrel 5.

The lock nut 33*b*D of the fifth embodiment is applicable to the embodiments 2 and 3. The tapered inner circumferential face 45*b* may be straight instead of tapered.

A ball-game bat according to a sixth embodiment of the present invention will be explained with reference to FIG. 9 that is a sectional view illustrating a connector of the bat. The sixth embodiment is basically the same as the first embodiment of FIG. 3, and therefore, the same or corresponding parts are represented with the same reference marks or the same reference marks plus "E" to omit a repetition of explanations.

According to the sixth embodiment, the connector 7E has a lock nut 33*b* provided with an integrated tapered cylinder 47 made of, for example, resin. The tapered cylinder 47 has a tapered outer circumferential face 47*a* and a tapered inner circumferential face 47*b*. The largest diameter of the tapered outer circumferential face 47*a* is equal to the outer diameter of a barrel joint 11 (FIG. 3) and the outer diameter of the lock nut 33*b*. The smallest diameter thereof is substantially equal to the outer diameter of a handle 3 (FIG. 3) at a position where the tapered cylinder 47 engages with the handle 3.

The largest diameter r3 of the tapered inner circumferential face 47*b* is equal to the smallest diameter r4 of a handle connection 25 of the connector 7E. The taper of the tapered inner circumferential face 47*b* is the same as the taper of the handle connection 25 of the connector 7E.

Figure 9:
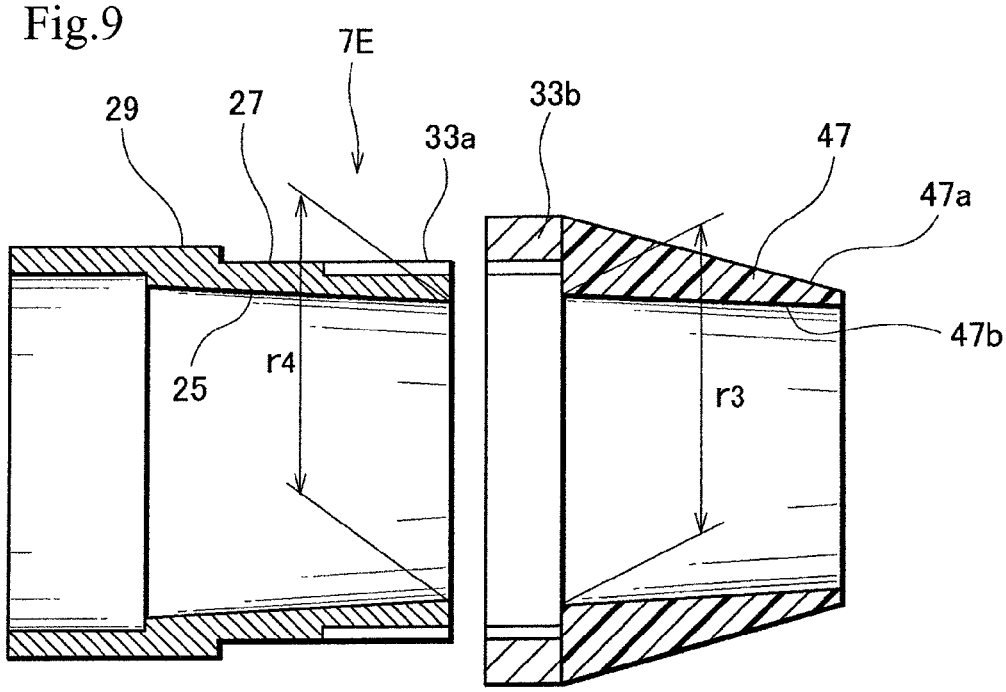
FIG. 9 is an exploded sectional view illustrating a connector of a ball-game bat according to a sixth embodiment of the present invention.

The connector 7E of FIG. 9 is before forming a bent 7*c* (FIG. 3). The tapered inner circumferential face 47*b* of the lock nut 33*b* is continuous to the handle connection 25 of the connector 7E, to receive the handle 3 and fit thereto. The tapered outer circumferential face 47*a* suppresses circumferential steps among the barrel joint 11, lock nut 33*b*, and handle 3, to smoothly continue the external shapes of the barrel 5, lock nut 33*b*, and handle 3.

The tapered cylinder 47 receives bending force applied between the handle 3 and the barrel 5, thereby improving joint strength between the handle 3 and the barrel 5.

The lock nut 33*b* of the sixth embodiment is applicable to the embodiments 2 and 3. The tapered inner circumferential face 47*b* may be straight instead of tapered.

Figure 10:
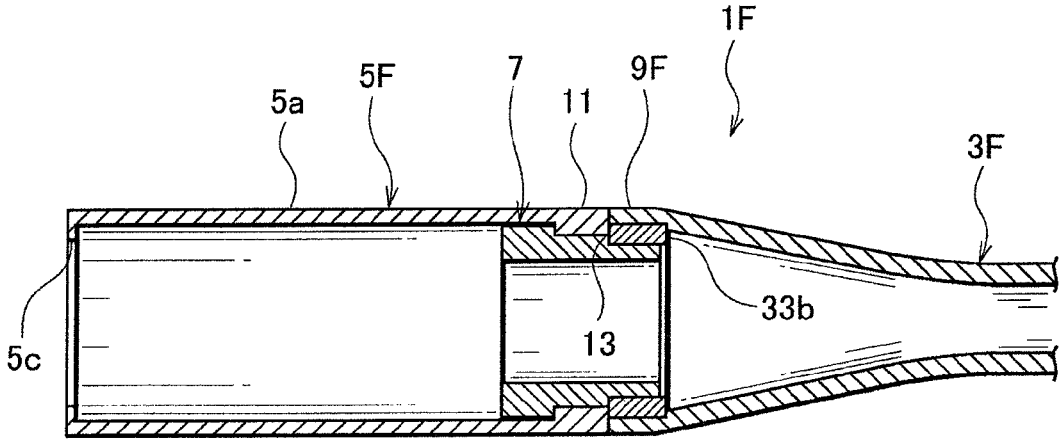
FIG. 10 is a sectional view illustrating a ball-game bat according to a seventh embodiment of the present invention with a cap and a knob omitted.
Figure 11:
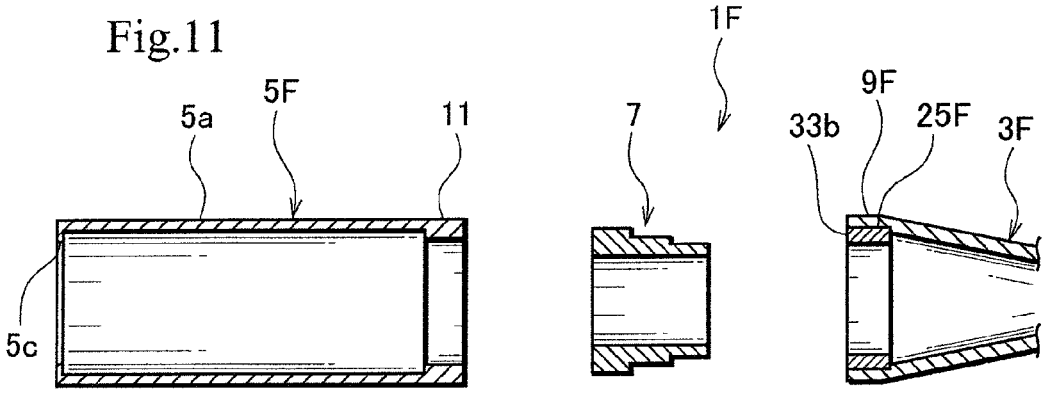
FIG. 11 is an exploded sectional view illustrating the bat of FIG. 10.
Figure 12:
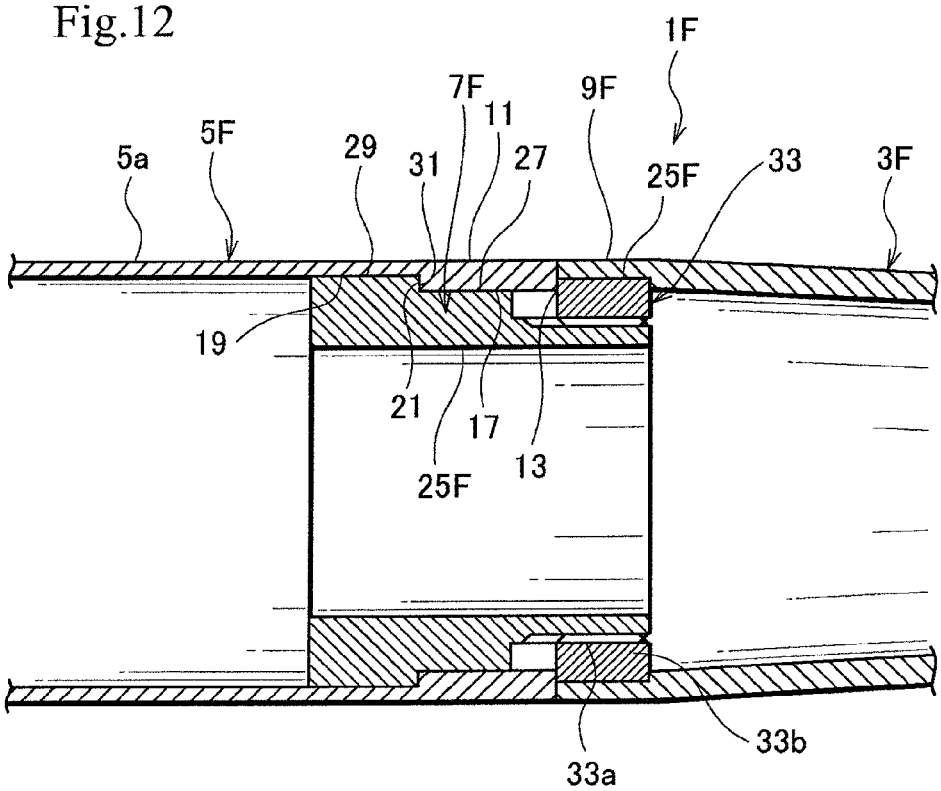
FIG. 12 is an enlarged sectional view illustrating an essential part of the bat of FIG. 10.

A ball-game bat according to a seventh embodiment of the present invention will be explained with reference to FIGS. 10 to 12 in which FIG. 10 is a sectional view illustrating the bat with a cap and a knob omitted, FIG. 11 is an exploded sectional view illustrating the bat, and FIG. 12 is an enlarged sectional view illustrating an essential part of the bat. The seventh embodiment is basically the same as the first embodiment of FIG. 3, and therefore, the same or corresponding parts are represented with the same reference marks or the same reference marks plus "F" to omit a repetition of explanations.

According to the seventh embodiment, a handle 3F of the bat IF is provided with a large-diameter handle joint 9F that is integrally fixed to a handle connection 25F formed around a lock nut 33*b* of an outer fastener 33F. The outer diameter of the handle joint 9F is equal to the outer diameter of a barrel joint 11 of a barrel 5F.

The barrel 5F has a straight pipe shape over a body part 5*a* and the barrel joint 11. The handle connection 25F of the connector 7F is also straight.

The seventh embodiment smoothly continues the handle 3F and barrel 5 without circumferential steps.

Although the present invention has been described above by reference to certain embodiments of the present invention, the present invention is not limited to the embodiments. Modifications and variations of the embodiments described above will occur to those skilled in the art in light of the teachings.

For example, instead of the bent (inner fastener) 7*c* formed by spinning, taper pipe threads may be used to join the handle 3 and connector 7 together. The outer fastener 33 may be replaced with a part formed by caulking or spinning.

The connector 7 may be integral with the handle 3.

The receiver 21 and stopper 31 may be tapered faces instead of the faces orthogonal to the center axis.

The cap of the barrel 5 may be integral with the barrel 5. In this case, the connector 7 and handle 3 are assembled to the barrel 5 through a top opening of the barrel 5 before forming the cap at the top. Thereafter, the top of the barrel 5 is formed into the cap by spinning.

The barrel 5 (5F) may be made of a single pipe, a multiple structure of two to four pipes inwardly layered with gaps among them, a multiple structure of two to three pipes outwardly layered with gaps among them, a foam containing structure, or a multilayered pipe having two to three layers without a gap.

The handle 3 may be made of wood, aluminum alloy, FRP, or resin. The bat 1 may be made of wood (single wood, plywood, and the like), aluminum alloy (duralumin), FRP (C-FRP, G-FRP, and the like), scandium alloy, titanium alloy, and the like.

The present invention is applicable to batting and hitting tools including ball-game bats and golf clubs.

What is claimed is:

1. A batting tool comprising:

a handle having a handle joint;

a barrel having a barrel joint and a barrel joint opening at an end of the barrel joint; and a connector connecting the handle joint and barrel joint together, the barrel joint being formed as a cylindrical body that defines a terminal end face at the barrel joint opening and having:

a first support hole formed proximal to the barrel joint opening;

a second support hole formed distal to the barrel joint opening and having a larger diameter than the first support hole; and a receiver formed between the first and second support holes, and the connector defining a connector body disposed in the barrel joint and having:

a handle connection connected to the handle joint;

a first barrel connection formed on an outer periphery of the connector body and engaging with the first support hole;

a second barrel connection formed on the outer periphery of the connector body and engaging with the second support hole;

a stopper formed between the first and second barrel connections;

a connector body extension formed as a one-piece construction with the connector body, the connector body extension being continuous to the first barrel connection so as to axially protrude beyond a terminal end face of the barrel joint; and an outer fastener including an external threading formed on an outer periphery of the connector body extension and a lock nut fastened to the external threading so that the lock nut is pressed into engagement with the terminal end face of the barrel joint, said engagement providing a direct connection of the connector body with the barrel joint and drawing the stopper toward and against the receiver so that the handle joint and barrel joint are connected.

2. The batting tool of claim 1, wherein the receiver is a face orthogonal to an axis of the first and second support holes, and the stopper is a face orthogonal to an axis of the first and second barrel connections.

3. A batting tool comprising:

a handle having a handle joint that has a tapered external shape that widens toward a front end thereof;

a barrel having a barrel joint and a barrel joint opening at an end of the barrel joint; and a connector connecting the handle joint and barrel joint together, the barrel joint having:

a first support hole formed proximal to the barrel joint opening;

a second support hole formed distal to the barrel joint opening and having a larger diameter than the first support hole; and a receiver formed between the first and second support holes, the connector having:

a handle connection connected to the handle joint, in which the handle connection is a hole formed on an inner periphery of the connector and having a tapered inner shape to fit to the handle joint of the handle;

a first barrel connection formed on an outer periphery of the connector and engaging with the first support hole;

a second barrel connection formed on the outer periphery of the connector and engaging with the second support hole;

a stopper formed between the first and second barrel connections;

an outer fastener engaging with a periphery of the barrel joint opening and being tightened to press the stopper and receiver to each other; and an inner fastener engaging with the front end of the handle, to fasten the handle connection and handle joint together.

4. The batting tool of claim 1, wherein the outer fastener has a tapered cylinder configured to suppress a step between the barrel joint and the handle and smoothly continue external shapes of the barrel joint and handle.

5. The batting tool of claim 1, wherein the handle joint is fitted around the outer fastener.

6. A batting tool comprising:

a handle having a handle joint that has a tapered external shape that widens toward a front end thereof;

a barrel having a barrel joint and a barrel joint opening at an end of the barrel joint; and a connector connecting the handle joint and barrel joint together, the barrel joint having:

a first support hole formed proximal to the barrel joint opening;

a second support hole formed distal to the barrel joint opening and having a larger diameter than the first support hole; and a receiver formed between the first and second support holes, the connector having:

a handle connection connected to the handle joint, in which the handle connection is a hole formed on an inner periphery of the connector and having a tapered inner shape to fit to the handle joint of the handle;

a first barrel connection formed on an outer periphery of the connector and engaging with the first support hole;

a second barrel connection formed on the outer periphery of the connector and engaging with the second support hole;

a stopper formed between the first and second barrel connections;

an outer fastener engaging with a periphery of the barrel joint opening and being tightened to press the stopper and receiver to each other; and an inner fastener being a bent formed by spinning and engaging with the front end of the handle, to fasten the handle connection and handle joint together.

7. The batting tool of claim 1, further comprising:

a projection formed on one of the barrel joint of the barrel and the connector and a recess formed on the other thereof; and the projection and recess engaging with each other to prevent a relative turn between the barrel and the connector.

8. The batting tool of claim 1, further comprising:

an internal thread formed on the first support hole and an external thread formed on the first barrel connection; and the threads being fastened to each other.

9. The batting tool of claim 1, wherein the barrel is a part of the bat to hit a ball.

* * * * *